United States Patent [19]

Hill et al.

[11] Patent Number: 4,869,025

[45] Date of Patent: Sep. 26, 1989

[54] GRINDING MACHINE, IN PARTICULAR FOR GRINDING SCISSORS PARTS

[75] Inventors: Roy A. Hill, Statesboro, Ga.; Klaus Datum, Solingen, Fed. Rep. of Germany

[73] Assignee: E. Siepmann & Co. (GmbH & Co.), Solingen, Fed. Rep. of Germany

[21] Appl. No.: 144,494

[22] Filed: Jan. 15, 1988

[30] Foreign Application Priority Data

Jan. 20, 1987 [DE] Fed. Rep. of Germany ..... 3701423

[51] Int. Cl.[4] ..... B24B 3/52

[52] U.S. Cl. ..... 51/122; 51/83 BS; 51/84 BS; 51/91 BS; 51/92 BS; 51/109 BS; 51/221 BS

[58] Field of Search ..... 51/83 BS, 84 BS, 85 BS, 51/86 BS, 91 BS, 92 BS, 122, 113, 114, 221 BS, 224, 231, 234, 125.5, 98.5, 98 BS, 109 BS

[56] References Cited

U.S. PATENT DOCUMENTS

| | | | |
|---|---|---|---|
| 1,909,033 | 5/1933 | Yerkey . | |
| 3,054,229 | 9/1962 | Peasley | 51/122 |
| 3,885,352 | 5/1975 | Juranitch | 51/92 BS |
| 3,889,425 | 6/1975 | Miyamoto | 51/125.5 |
| 3,895,462 | 7/1975 | Gorin | 51/85 BS |
| 4,528,778 | 7/1985 | Wolff | 51/91 BS |

FOREIGN PATENT DOCUMENTS

| | | | |
|---|---|---|---|
| 0249588 | 12/1987 | European Pat. Off. | 51/92 BS |
| 501264 | 12/1930 | Fed. Rep. of Germany . | |
| 1235767 | 3/1967 | Fed. Rep. of Germany . | |
| 3005606 | 8/1981 | Fed. Rep. of Germany . | |

*Primary Examiner*—Frederick R. Schmidt
*Assistant Examiner*—Blynn Shideler
*Attorney, Agent, or Firm*—Browdy and Neimark

[57] ABSTRACT

A grinding machine, in particular for grinding scissors parts or knife blades, has a grinding wheel that can be driven to rotate, a workpiece socket, and a guide device for guiding the workpiece socket during the grinding operation. In order to enable fully automatic grinding of all the surfaces on a workpiece that are to be ground, in particular on scissors parts, knife blades or the like, using only a single grinding machine, the workpiece socket is disposed on a compound slide that is displaceable in an X-Y plane and is embodied as rotatable about a pivot axis (Z axis). The workpiece socket has at least one clamping device, which is disposed on the workpiece socket in such a manner that the primary longitudinal direction of a workpiece fastened in place extends substantially parallel to the pivot axis (Z axis). The pivot axis (Z axis) of the workpiece socket extends parallel to the plane of motion (X-Y plane) of the compound slide and at right angles to the axis of rotation of the grinding wheel embodied as a cup wheel.

11 Claims, 7 Drawing Sheets

GRINDING MACHINE, IN PARTICULAR FOR GRINDING SCISSORS PARTS

FIELD OF THE INVENTION

The invention relates to a grinding machine for grinding elongated parts having faces to be ground.

BACKGROUND OF THE INVENTION

When automated grinding machines are to be used to grind workpieces of which the faces to be ground extend approximately parallel to one another and to a primary longitudinal direction of the workpiece, as for instance is the case with scissors parts, knives and the like, then the fundamental problem arises that a different grinding machine is necessary for each face to be ground, since the faces to be ground are all different and since various clamping devices are needed in each case for retaining the workpiece, depending on which face is to be ground. The guidance along the grinding wheel of the workpiece socket that holds a workpiece is effected via copying control devices (see examined German Patent Application DE-AS 12 35 767). The basic problem that still arises here is that on scissors parts, for instance, not only curved or contoured edges, but skewed surfaces as well, must be ground.

From German Patent 501 264, a polishing device for cutlery is known, wherein a rotatable wheel is provided that has numerous sockets for attaching the pieces of cutlery to be polished. These sockets are pivotably disposed on the wheel and are spring loaded, so that upon a rotation of the wheel, the individual pieces of cutlery are pressed against the polishing wheel with their particular face to be polished at that time.

From U.S. Pat. No. 1,909,033, a scissors grinding apparatus is known in which the blade of a scissors is automatically moved past a grinding wheel. A slide is movable on a shaft that is parallel to the grinding wheel axis; the slide has an upper clamp into which the scissors part is clamped. The scissors part clamped in this way is moved past the outer circumference of the grinding wheel, and by this means its cutting edge is ground.

From German Patent Disclosure Document DE-OS 30 05 606, a numerically controlled grinding machine is known for profile grinding of workpieces, in particular for grinding the roots of turbine blades. This grinding machine has a workpiece socket that is displaceable on a compound slide in the X and Y direction. The workpiece socket is also pivotable about an axis that is located parallel to the X-Y plane, and also parallel to the axis of rotation of the grinding wheels. The grinding wheels themselves grind in the circumferential direction. The machine is designed for so-called pendulum grinding; that is, the grinding wheels, which are likewise movable with their axes toward and away from one another, are positioned during the grinding operation in which the workpiece swings back and forth about its axis.

SUMMARY OF THE INVENTION

It is the object of the invention to embody a grinding machine of the above-described generic type such that fully automatic grinding of the surface to be ground on a scissors part, knife blade, or manual cutting tool using only a single grinding machine is made possible.

This object is attained in accordance with the present invention which provides a grinding machine having a grinding wheel driven to rotate about an axis of rotation, having a workpiece socket with a clamping device for retaining the workpiece during grinding, and a guide device for grinding the workpiece socket during the grinding operation. Because the workpiece socket with the clamping devices is displaceable in the X and Y direction and because of the rotatability of the workpiece socket about a Z axis, it becomes possible, first, to guide the workpieces along the grinding wheel along arbitrary curves, including those provided for grinding twisted curved surfaces, and second, to rotate the workpiece socket, in order to automatically fill it, into a suitable position for inserting or removing workpieces; displacement movement in the X or Y direction can also be superimposed upon this rotation. Manual firming chisels, standard chisels and the like. Grinding by means of a cup wheel, which grinds with its face edge, and having the cup stationary during grinding, makes it possible to grind a face in only a single pass, rather than grinding back and forth. The grinding machine according to the invention is accordingly very simple in construction. The options of motion of the grinding machine are sufficient for all currently known parts of the aforementioned generic type. Only if scissors having highly curved scissors parts, such as nail scissors, are to be ground does the workpiece socket additionally have to be rotatable about an axis that is perpendicular to the plane of displacement of the compound slide.

The further features wherein the workpiece socket has a number of clamping devices corresponding to the number of faces to be ground on the workpiece enable an automated conversion of the workpieces from one clamping device to another clamping device, so that all the faces to be ground can be ground in one pass on one machine. Surfaces that are adjacent one another in their location and can be ground with only one fastening with suitable pivoting of the workpiece socket can thus be considered as merely a single face. In this respect the machine also encompasses versions in which the number of actual faces to be ground is greater than the number of clamping devices.

Means are provided on the grinding machine of the present invention whereby the workpieces to be ground can be held completely securely in the clamping devices, so that even if the pressure or energy supply systems should fail they cannot fall out.

In another embodiment of the invention, a workpiece socket having four clamping devices for grinding scissors parts is provided.

The structure of other embodiments of the present grinding machine makes it possible to generate a concave, crowned or flat ground surface on the workpiece to be ground.

Further advantages and characteristics of the invention will become apparent from the ensuing description of an exemplary embodiment, referring to the drawing.

DESCRIPTION OF THE PREFERRED EMBODIMENT

Figure 1:
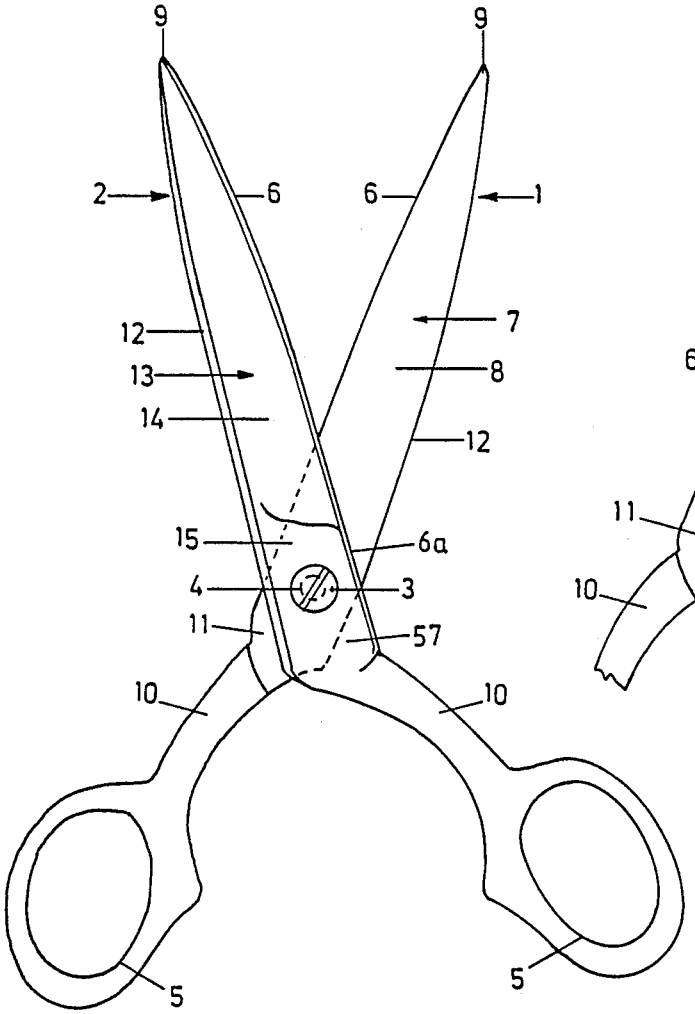
FIG. 1 is a plan view of a pair of scissors.
Figure 2:
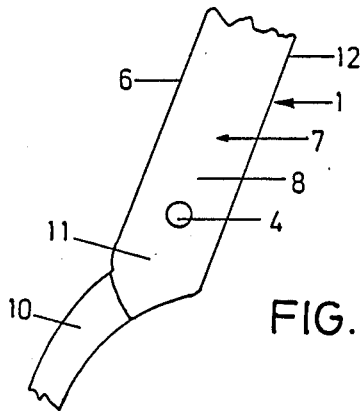
FIG. 2 is a plan view on a portion of one scissors part.

The illustration of a pair of scissors in FIG. 1 and a detail of these scissors in FIG. 2 serve merely to explain some of the terminology. Each pair of scissors comprises two scissors parts 1, 2, which are not identical and are also known as the lower part (scissors part 1) and upper part (scissors part 2). The two scissors parts 1, 2 are pivotably attached to one another by means of a screw 3, which is passed through a suitable bore in one scissors part 2 and a hole 4 in the other scissors part 1. Each scissors part 1, 2 has an eye 5, for the user's thumb or finger, in other words for operating the scissors. Each scissors part 1, 2 has a cutting edge 6 or facet. These cutting edges 6 are moved past one another during cutting. The inner surfaces 7 facing one another of each scissors part 1, 2, in the vicinity adjacent the cutting edges 6, are called hollows 8, because in this vicinity they do not have plane surfaces but instead are curved away from one another. These hollows 8 extend substantially from the screw 3 as far as the respective tip 9 of the respective scissors part 1, 2. In the vicinity between the screw 3 and the stem 10 which carries the eye 5, that is, the vicinity known as the midsection 11, the inner surfaces 7 of each scissors part 1, 2 are provided with a run-up face, which when a pair of scissors is closed cause concave cutting edges 6 to move in a shearing fashion past one another.

On the outsides remote from the cutting edges 6, each scissors part 1, 2 has a back 12. On the outer face 13 remote from the respective inner face 7 it also has a blade 14, each being associated with the hollow 8, as well as a so-called joint 15, which is associated with the midsection 11. The screw 3 is disposed in the vicinity of the joint 15. In an extension of the cutting edge 6, a narrow edge **6*a*, the so-called facet bar, is embodied on the joint 15 opposite the back 12**.

On each scissors part 1 or 2 the inner face 7, that is, the hollow 8 and the midsection 11, must be ground in one operation, the outer face 13 or in other words the blade 14 and the joint 15 must be ground in another operation, the back 12 in yet another operation, and the cutting edge 6 and the narrow edge **6*a* ground in still another operation. The order of these four grinding operations is not dictated by the above order. As the drawing illustrates, all four regions to be ground extend substantially parallel to one another and to a common primary longitudinal direction 15*a* of the inner face 7, outer face 13, cutting edge 6 and back 12. Although the scissors part 1 shown in the drawings to be described below is structurally not identical to the scissors part 1 of FIG. 1**, the reference numerals used for the various terms described above will be used again, as much as necessary, for the sake of overall agreement.

Figure 3:
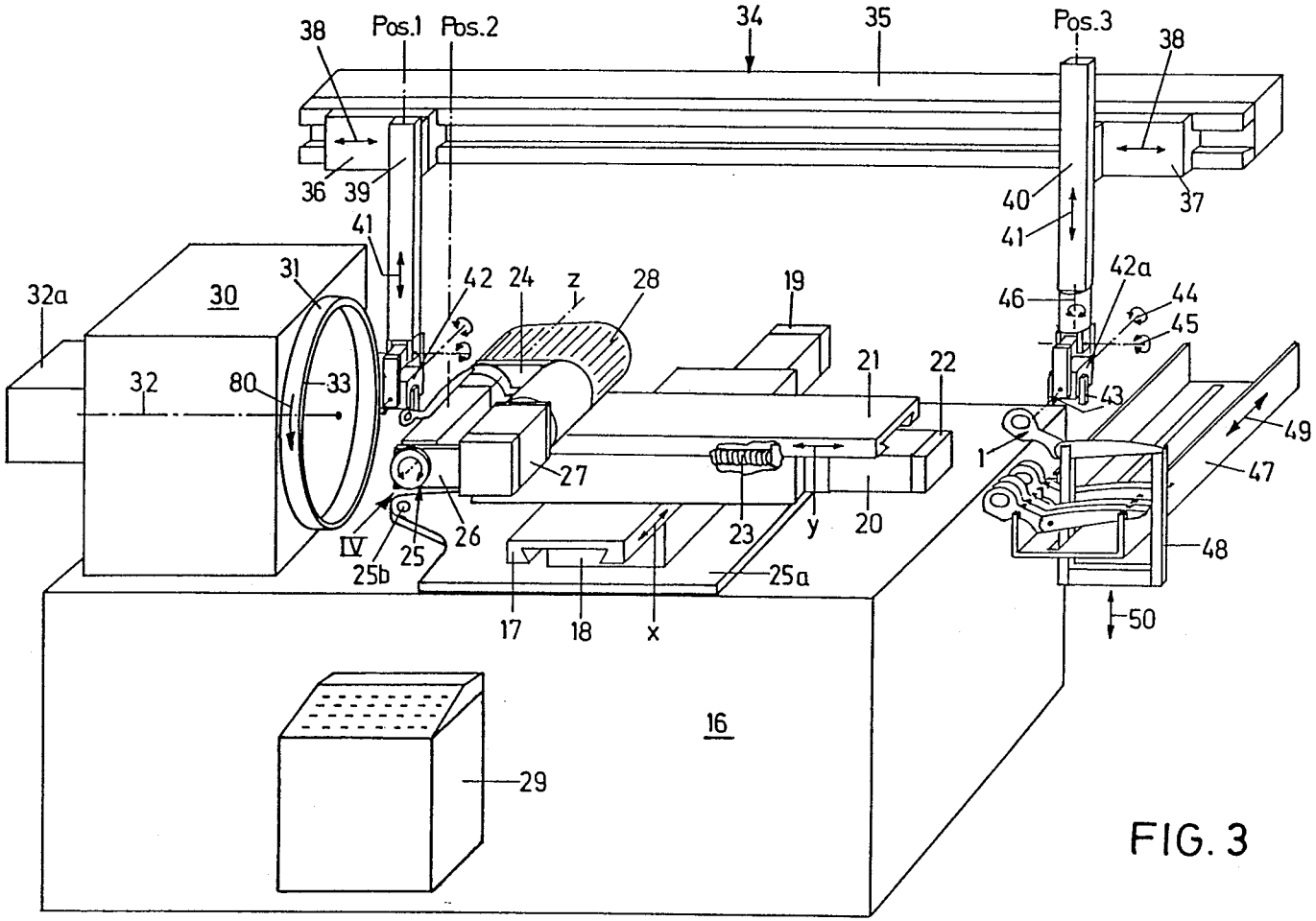
FIG. 3 is a perspective view of a grinding machine according to the inventin, with a workpiece feeder.

The grinding machine shown particularly in FIG. 3 has a machine frame 16, on which an X slide 17 is displaceably disposed on a guide 18 that is attached in a stationary fashion to the machine frame 16. The X slide 17 is drivable by means of a motor 19, which is only suggested in the drawing. Attached to the X slide 17 is a guide 20 for a Y slide, on which the Y slide 21 is displaceably guided by means of a motor 22 via a spindle drive 23 suggested in the drawing. The X slide 17 and the Y slide 21 are displaceable perpendicular to one another in the X and Y direction, respectively. The Y slide 21, in other words, is displaceable by common triggering of the motors 19 and 22 in an X-Y plane that is defined by the X direction and the Y direction. In other words, the two slides 17, 21 form what is known as a compound slide. Cantilevered arms 24, 26 for a workpiece socket 25 are attached to the Y slide 21. By means of these cantilevered arms 24, 26, the workpiece socket 25 is made to project freely beyond the Y slide 21. The workpiece socket 25 is rotatable or pivotable about its Z axis, which is parallel to the X axis. As shown in FIG. 3, a motor 27 is provided on the Y slide 21 to effect this pivoting, and via a belt drive 28 the motor brings about pivoting movements of the workpiece socket 25 about the Z axis. The X slide 17 and hence the entire compound slide along with the workpiece socket 25 is disposed on a pivotable plate **25*a*, which is pivotably supported about a vertial axis 25*b* on the machine frame 16**.

The three motors 19, 22, 27 are triggerable via a computerized numerical control means 29. A grinding device 30 is also attached to the machine frame 16, and is provided with a cup wheel 31, which is rotationally drivable by means of a motor **32*a* about an axis of rotation 32 that is parallel to the middle position of the Y axis. The axis of rotation 32 is stationary during the grinding; that is, the cup wheel 31 cannot be positioned with respect to the scissors part 1 during the grinding. A repositioning that compensates for wear of the cup wheel 31 can, however, be accomplished between two grinding operations. Because of its cup-shaped embodiment, only its narrow face edge 33 comes into engagement during grinding. The axis 25*b* of the pivotable plate 25*a* is located approximately beneath the cup wheel 31. The plate 25*a* along with the compound slide and the workpiece socket 25 can be pivoted by approximately 15' with respect to a middle position parallel to the Y axis. This makes it possible during grinding to generate a hollow grind, a crowned grind or a flat grind on the workpiece to be ground. For producing particular parts, the setting of the plate 25*a* remains constant, that is, it is constant while any one kind of part is being ground. In the grinding of scissors parts 1, 2, their inner face 7** must be provided with a hollow grind. In that case, all the faces to be ground receive a concave grinding.

Above the workpiece socket 25, a workpiece feeder 34 is provided, which has a rail 35 extending horizontally and parallel to the Y axis, on which rail two slides 36, 37 are linearly displaceable in the direction 38. A transport arm 39 and 40, respectively, is disposed on each slide 36, 37 and is displaceable—likewise in the manner of a slide—in the direction 41, which extends at right angles to the direction 38 and vertically. At the lower end of each transport arm 39 or 40, a two-finger parallel gripper 42, **42*a* is attached; this is a component part known from robotics. This gripper 42, 42*a* can grasp a workpiece, in the present case a scissors part 1, between its fingers 43. The grippers 42, 42*a* associated with the two transport arms 39, 40 are each pivotable about three respective pivot axes 44, 45, 46 arranged at right angles to one another, two of which, the axes 44, 45, extend parallel to the X and Y directions. The drive motors for the slide 36, 37, the transport arms 39, 40, the grippers 42, 42a and the fingers 43 are now shown. Their triggering is also effected by the control means 29**.

A cassette-like workpiece storage device 47 is disposed in the vicinity of the machine frame 16 and in it workpieces, that is, scissors parts 1, are retained beside and parallel to one another and can be lifted out by means of a lifting device 48. They are then grasped by the gripper 42a of the transport arm 40. Next, the slide 38 moves in the direction toward the grinding device 30, where the scissors part 1 is transferred in a manner to be described in further detail below. The drive of the storage device 47 in the direction of the movement arrow 49 and of the lifting device 48 in the direction of the movement arrow 50 is likewise done via motors, not shown, which are triggered by the control means 29.

Instead of the above-described workpiece feeder 34, an industrial robot available in commerce can also be used.

Figure 7:
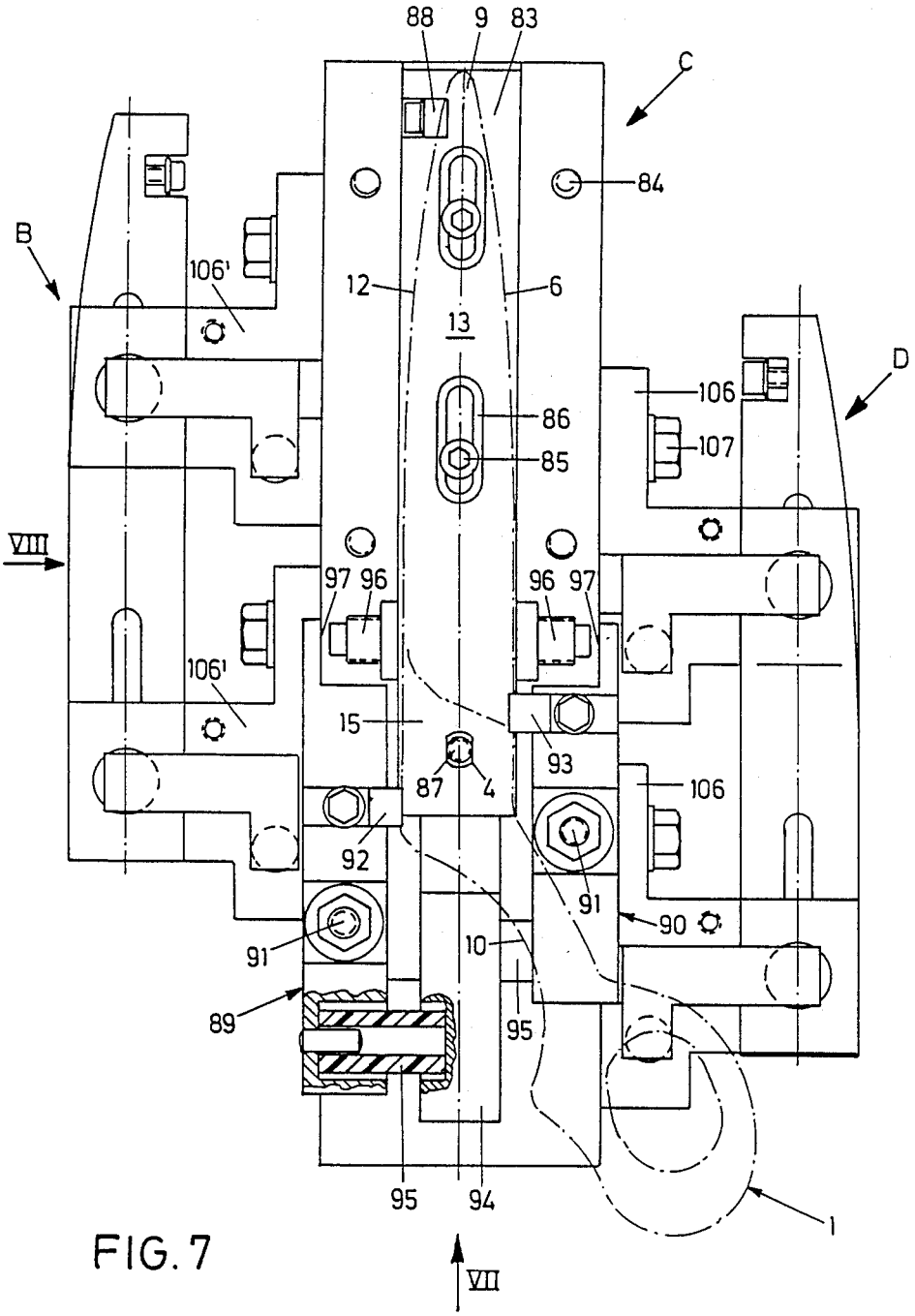
FIG. 7 is a view of the workpiece socket in the direction of the arrow VII in FIG. 4.

The workpiece socket 25 has two clamping devices A, B, C, D, which are disposed approximately parallel to the Z axis and are each offset from one another, at right angles to the Z axis, by 90°, so that a clamping device B, as a result of a rotation of the workpiece socket 25 about 90° about the Z axis, arrives at the location of a neighboring clamping device A or C. This is particularly clearly shown in FIG. 4. Grinding of a scissors part 1 is performed in a position in which the respective clamping device A, B, C or D is located in front of the grinding wheel 31, that is, in the position shown in FIG. 4 for the clamping device D. The clamping device A serves to receive a scissors part 1 in a position such that its inner face 7, that is, its hollow 8 and its midsection 11, are ground. The clamping device B serves to receive the scissors part 1 for grinding of its back 12. The clamping device C serves to hold the scissors part 1 for the grinding of its outer face 13, that is, the blade 14 and joint 15, while the clamping device D serves to receive the scissors part 1 for the grinding of its cutting edge 6 and narrow edge 6a. In order to make this clear, scissors parts 1 are shown in FIGS. 5 and 7 in their respective fastening position in the clamping device A, B, C or D.

The four clamping devices A-D are attached to an approximately block-shaped base structure 51, which is drivable to pivot about the Z axis.

The clamping device A has a bottom plate 52, on which a likewise largely platform-like support holder 53 is located, on which in turn a support 54 for the scissors part 1 is disposed. Thus the support holder 53 carries the support 54. The clamping device A is secured to the base structure 51 by means of screws 55.

The support holder 53 is pivotable about a pivot axis or pin 56 that extends crosswise to the Z axis and is located in the vicinity in which the tip 9 of the scissors part 1 is disposed. On the opposite end, that is, oriented toward the transitional zone 57 between the stem 10 and the midsection 11, there are two stops 58, 59 in the manner of bell cranks, against which stops a scissors part 1, resting on the support 54 with its outer face 13, in other words with its inner face 7 facing freely upward, is pressed, specifically with the transitional zone 57. A pre-stressed compression spring 60, for instance comprising a rubber-like material, is disposed underneath the support holder 53, specifically between it and the bottom plate 52, on the end of the support holder 53 opposite the pivot pin 56. This compression spring 60 presses the support holder 53 and thus the support 54 as well as the scissors part 1 resting on it upwardly, so that the scissors part is pressed against the stops 58, 59. The hole 4 here is held by a centering pin 61, embodied on the support 54. The support 54 is connected by means of screws 62, via oblong-slot connections 63, with the support holder 53 in a longitudinally adjustable manner.

Figure 6:
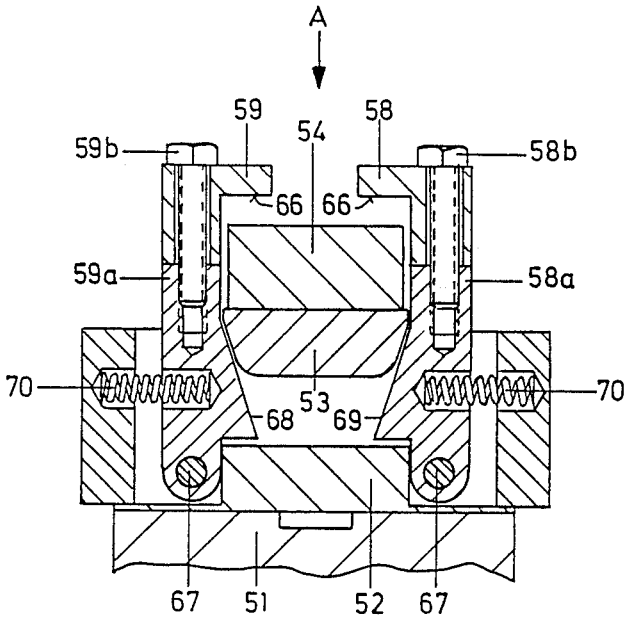
FIG. 6 is a section taken through a clamping device along the line VI—VI of FIG. 5.

The bell-crank-like stops 58, 59 are secured on opening/closing levers 58a, 59a by means of screws 58b, 59b, which are pivotably supported in a bearing housing 64 that is screwed to the bottom plate 52 by means of screws 65. As shown particularly in FIG. 6, the stops 58, 59 are provided with stop faces 66. On their opposite ends, they are each pivotably supported about a respective pivot axis of pin 67. In this vicinity, there are guide faces 68, 69 facing one another embodied on the levers 58a and 59a, respectively, and converging toward one another away from the stop faces 66. The support holder 53 is located in between them. If the support holder 53 is pivoted toward the bottom plate 52 counter to the force of the compression spring 60, then the two levers 58a, 59a and the stops 58, 59 are pivoted away from one another in the vicinity of their stop faces 66; in other words, the clamping device is opened. The two stops 58, 59 are pivoted away from one another far enough that a scissors part can be placed upon the support 54 or removed downward from it through these stops. As FIG. 6 shows, the two bell-crank-like stops 58, 59 are each loaded externally with pre-stressed compression springs 70, so that they are always pressed toward one another. If the support holder 53 and thus the support 54 as well are located in their clamping position, next to the stop faces 66, for a scissors part 1, then the stops 58, 59 are also correspondingly pressed toward one another. The stops 58, 59 and their stop faces 66 are immovable in the pivoting direction of the support holder 53; that is, the scissors part 1 is centered against the stop faces 66. The primary longitudinal direction 15a of the scissors part 1 extends approximately parallel to the Z axis, when the scissors part is in the clamped-in state.

The opening of this clamping device A counter to the force of the compression springs 60 and 70 is effected by means of a bell crank 74, which is supported on a bearing block 73 such that it is pivotable about a pivot axis 72. An upper actuation lever 74, extending approximately horizontally, of the bell cranks 71 rests on a driver 75 connected to the support 54. A hydraulically actuatable drive cylinder 77 rests against the other lever, serving as a drive lever 76, of the bell crank 71. When this drive cylinder 77 is subjected to compressed oil, the oil presses the support holder 53 toward the bottom plate 52 in the manner described. In other words, the closing of the clamping device A takes place exclusively via the pre-stressed compression springs 60, 70; the opening is effected via a hydraulically actuatable and correspondingly triggered drive cylinder 77.

In the vicinity of the tip 9 of the scissors part 1, a stop 78 is disposed on the support holder 53, against which stop the scissors part 1 rests with its still-unground cutting edge 6. The grinding of the inner face 7 takes place in a position of the clamping device A corresponding to the position of clamping device D in FIG. 4, in which the grinding wheel 31 moves in accordance with the force vector arrow 79 of FIG. 5. The rotational direction 80 corresponding to this is also shown in FIG. 3. Accordingly, during grinding, the scissors part 1 is pressed onto the support 54 by the pressing force in the Y direction and against the stop 78 by the grinding pressure in the rotational direction 80. The guidance of the scissors part 1 during grinding of the inner face 7 is effected in the X and Y direction by corresponding triggering of the motors 19, 22. The inner face 7 is rifled about the longitudinally axis 15*a* by pivoting about the Z axis, by means of suitable triggering of the motor 27. That is, a triggering of all three axes takes place, that is, the X, Y, and Z axes. In the vicinity of the stops 58, 59, the scissors part 1 rests with its joint 15 upon the support 54. After the grinding of the inner face 7, which is ground first, the scissors part thus still has a sufficient thickness in the vicinity of the inner face 7 and outer face 13, for the grinding of the outer face 13. This is the next step after the grinding of the inner face 7, whereupon the scissors part 1 is received in clamping device C, and therefore this clamping device will be described next.

The clamping device C likewise has a bottom plate 81, on which a support holder 82 is attached and on it, in turn, a support 83. The bottom plate 81 is secured by means of screws 84 on the base structure 51. The scissors part 1 is placed upon the support 83 with its already-ground inner face 7, so that its outer face 13 is free at the top, and its primary longitudinal direction 15*a* again extends approximately parallel to the Z axis. As shows in FIG. 7, the support 83 and the support holder 82 are secured by means of screws 85 and oblong-slot connections 86 on the bottom plate 81 such that they are adjustable in the longitudinal direction 15*a* of the scissors part 1. The support 83 likewise has a centering pin 87, which engages the hole 4 of the scissors part 1. In the vicinity of the tip 9 of the scissors part 1, a stop 88 is attached to the support 83, against which stop the scissors part 1 rests with its—still-unground—back 12.

Figure 8:
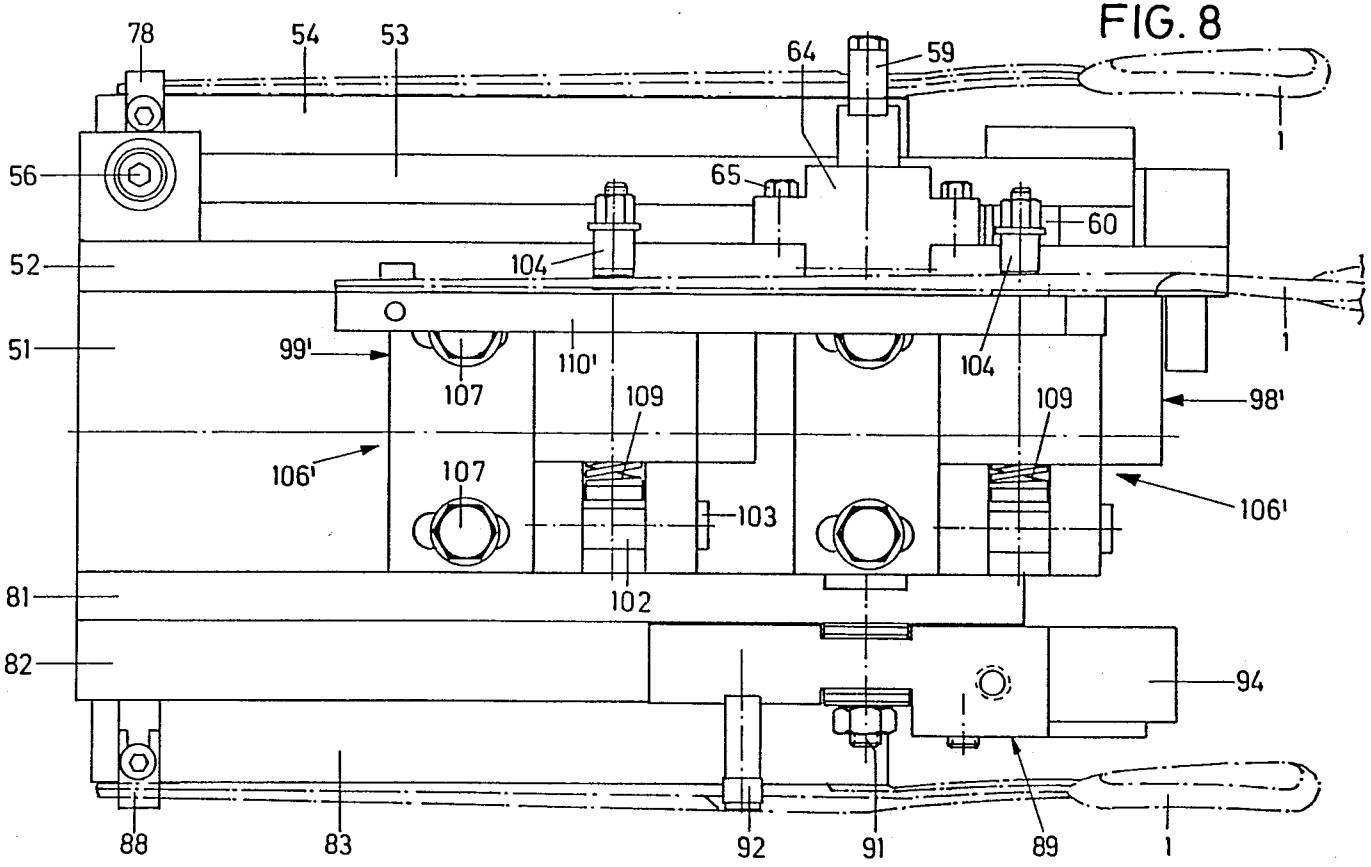
FIG. 8 shows a further view of the workpiece socket in the direction of the arrow VIII of FIG. 4.

In the vicinity of the stem 10 and joint 15 of the scissors part 1, that is, in the vicinity of the end opposite the tip 9 of the outer face 13 to be ground, two clamping levers 89, 90 are pivotably supported about pivot pins 91 on either side of the support 83 and substantially parallel to it; these clamping levers extend substantially at right angles to the support 83 or to the outer face 13 that is to be ground of the scissors part 1. These clamping levers 89, 90 each have a stop 92 or 93, respectively, on their end oriented toward the stop 88, of which the stop 92 comes to rest on the still-unground back 12 in the vicinity of its transition to the stem 10, and the stop 93 comes to rest on the still-unground narrow edge 6*a*. Viewed from the tip 9 of the scissors part 1, the stop 92, which like the stop 88 has come to rest on the back 12, is disposed behind the centering pin 87, while viewed from the tip 9, the stop 93 that has come to rest on the cutting edge 6 comes to rest before the centering pin 87. The two stops 92, 93 accordingly exert a torque about the centering pin 87 upon the scissors part 1, when pressure is exerted upon the scissors part 1, and this torque presses the back 12 of the scissors part 1 against the stop 88 in the vicinity of its tip 9, as a result of which a reliable, accurately centered location of the scissors part 1 in the clamping device is assured. As particularly shown in FIGS. 4 and 8, the stops 88, 92, 93 do not extend over the outer face 13 of the scissors part 1, so that the outer face 13 is completely free and can be engaged by the grinding wheel 31.

Between an abutment 94 joined to the bottom plate 81 and the ends of the clamping levers 89, 90 remote from the stops 92, 93, pre-stressed compression springs 95 are provided, which may for example comprise a rubber-like plastic. These compression springs 95 urge the clamping levers 89, 90 about the pivot pins 91 in such a manner that the stops 92, 93 are pressed toward one another or in other words against the scissors part 1. For opening the clamping device thus formed, hydraulically actuatable opening cylinders 96 are also attached to the support holder 82, in fact still before the stops 92, 93—as viewed from the tip 93 of the scissors part 1—and in the event of actuation these opening cylinders 96 come to rest against corresponding stop faces 97 of the clamping levers 89, 90 and pivot the clamping levers 89 or 90, respectively, about the pivot pins 91 counter to the force of the compression spring 95. The stops 92, 93 are as a result moved into a position spaced apart from one another such that a scissors part 1 resting on the support 84 can be lifted, or a scissors part 1 set down upon the support 83. Once the opening cylinders 96 have been relieved, the clamping levers 89, 90 are pivoted back into their closing position shown in FIG. 7.

Figure 4:
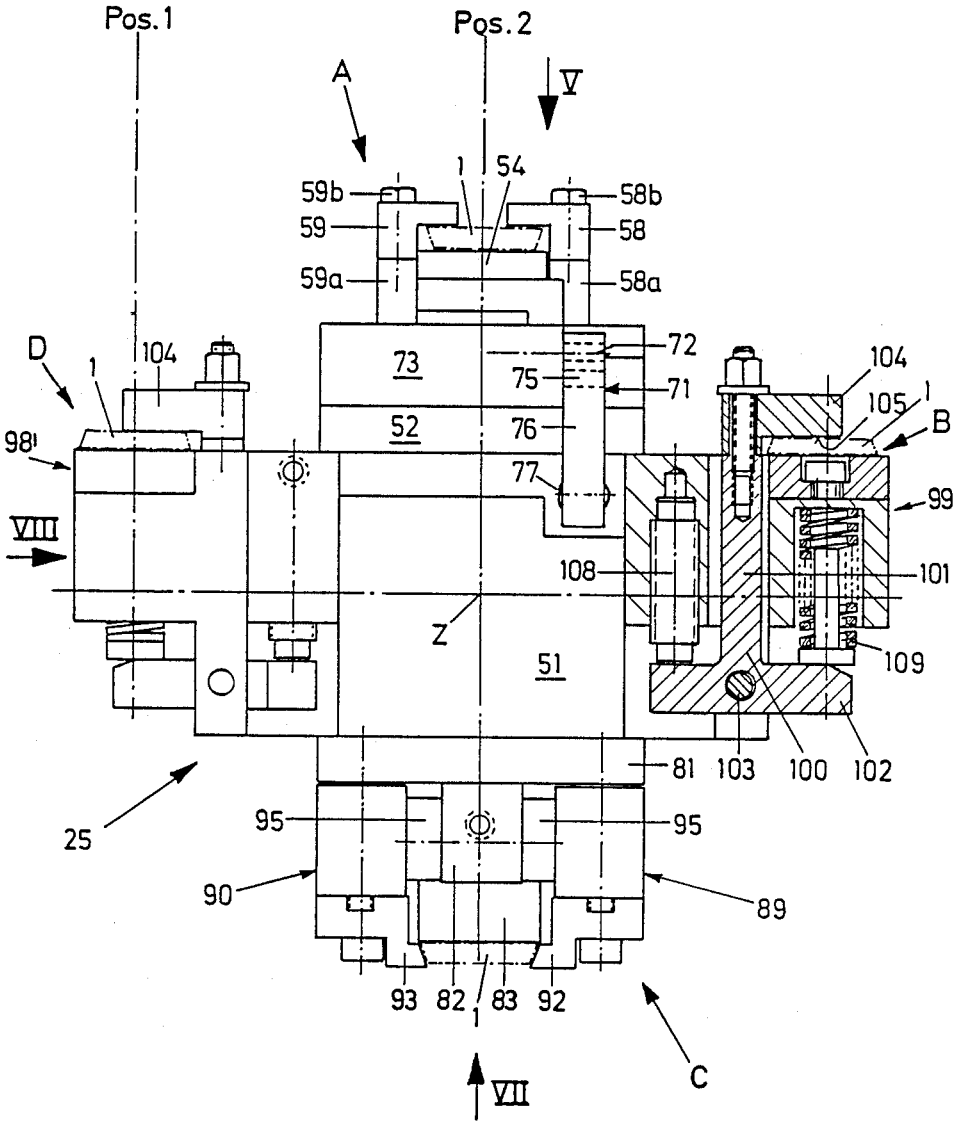
FIG. 4 is an end view of a workpiece socket having four clamping devices seen in the direction indicated by the arrow IV in FIGS. 3 and 5, in which one clamping device is shown in a sectional view taken along the line IV—IV of FIG. 5.
Figure 5:
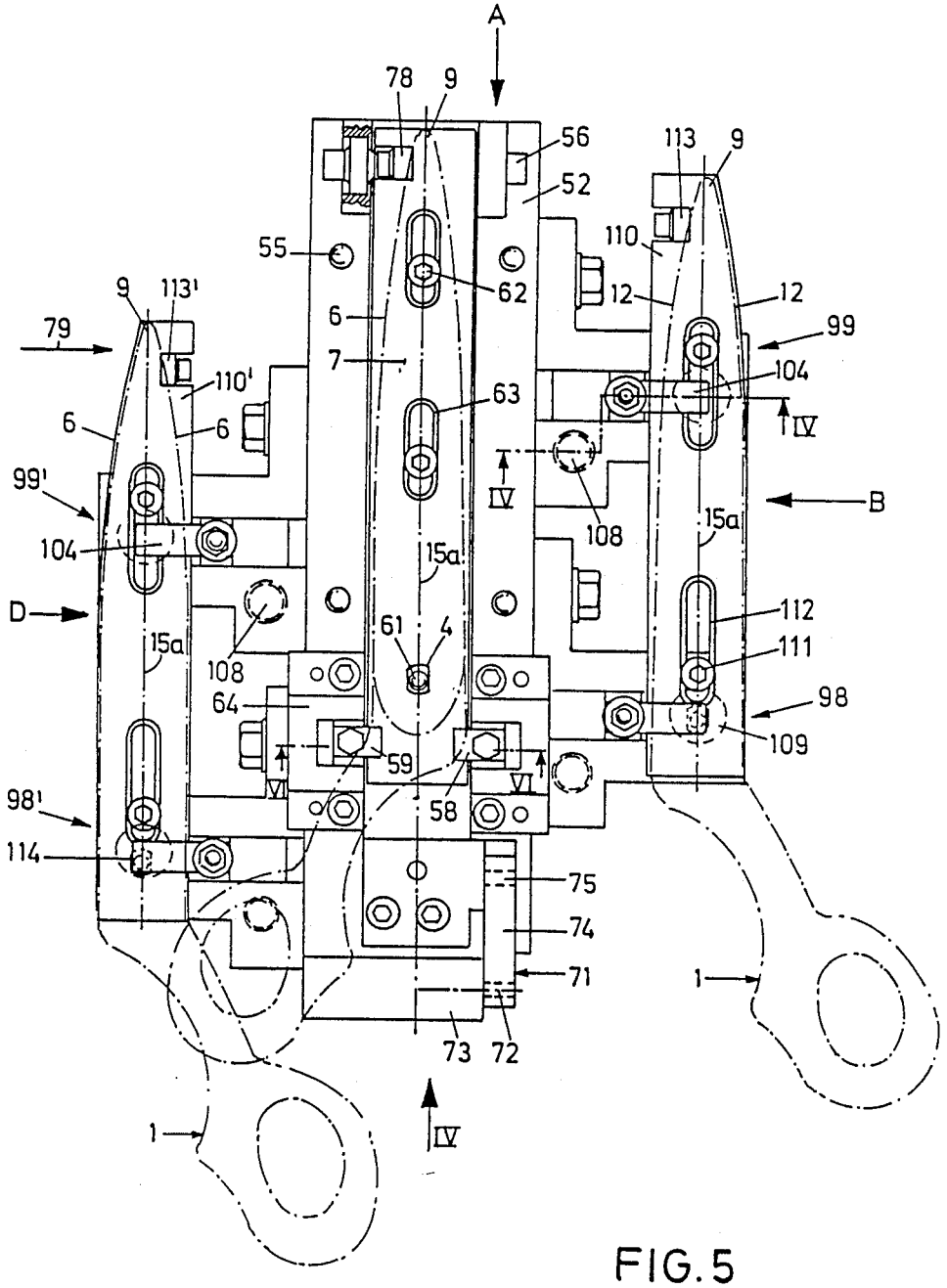
FIG. 5 is a plan view on the workpiece socket seen in the direction of the arrow V in FIG. 4.

The grinding of the outer face 13 of the scissors part 1 in the position clamped into place in the clamping device C likewise takes place when this clamping device C is in the position corresponding to the location of clamping device D in FIG. 4. The grinding force once again is exerted in accordance with the force vector arrow 79; that is, a force is exerted upon the scissors part 1 that presses it still more strongly against the stop 88. The scissors part 1 is also pressed upon the support 83 during grinding. Thus it has a precisely defined location. After grinding of the outer face 13, the outer face 13 and the inner face 7 have a precisely predetermined position with respect to one another.

The clamping devices B and D are embodied substantially mirror-symmetrically with respect to one another, so they can be described together. To the extent that the individual parts are identical, they are provided with the same reference numerals, while if they are only similar, because of the mirror symmetry, they are identified by the same numeral with a prime. Both clamping devices B and D each comprise two clamping devices 98, 99 or 98', 99', which are quite similar to one another. As the sectional view of FIG. 4, right, shows, they have a pivot lever 100 embodied like an upside-down T, which when it meets the longitudinal strut 101 and the crosswise strut 102 is pivotably supported about a pivot bearing 103. Located on the free end of the longitudinal strut 101 is a stop 104, which protrudes parallel to the crosswise strut 102, having a stop face 105 oriented toward the crosswise strut 102. The pivot lever 100 is supported on a bearing block 106 or 106', which is secured by screws 107 to the base structure 51 of the workpiece socket 25. A hydraulic actuatable opening cylinder 108 is disposed respectively between the longitudinal strut 101 of the pivot lever 100 on either side, supported on the one hand on the bearing block 106 and on the other on the crosswise strut 102. On the other side of the longitudinal strut 101, a pre-stressed helical compression spring 109 is provided, which likewise is supported at one end against the bearing block 106 or 106' and on the other against the crosswise strut 102. A respective support 110 or 110' is disposed on both bearig blocks 106 or 106', which belong to one another in pairs, below the stops 104 and oriented toward the stop faces 105; these supports 110 and 110' are adjustable in the longitudinal direction of the scissors part 1 to be placed upon them by means of screws 111 and oblong slot connections 112. A stop 113 or 113' is secured on the end of the particular support 110 or 110' oriented toward the tip 9 of the scissors part 1, and the back 12 of the scissors part 1, in the clamping device B, and the cutting edge 6 of the scissors part 1, in the clamping device D, both rest against this stop 113 or 113'. When the opening cylinder is not being actuated, the pivot lever 100 is pivoted by the compression spring 109 in such a manner that the stop 104 is moved with its stop face 105 toward the stop 110 or 110', as a result of which the scissors part 1 is firmly clamped on the stop 110 or 110'. To release this clamping, the opening cylinders 108 are hydraulically actuated, as a result of which the respective pivot lever 100 along with the corresponding stop 104 is pivoted counter to the force of the compression spring 109 and moved away from the respective support 110 or 110'. The grinding of the cutting edge 6 and of the narrow edge 6a takes place third. As a fourth and last step, the grinding of the back 12 of the scissors part 1 is performed. The scissors parts, in addition to the support they have in the vicinity of their tip 9 against the stop 113 or 113', also rest against a centering pin 114, which is embodied on the respective support 110 or 110' and engages the hole 4. Accordingly it is assured that the scissors parts are pressed by the grinding force 79 against the stops 113 or 11' and against the centering pins 114, with this primary longitudinal direction 15a again extending somewhat parallel to the Z axis.

One complete grinding cycle will now be described. The gripper 42 located on the slide 36 having the transport arm 39 can assume two positions—with respect to the rail 35—namely a position 1 and a position 2, which—as shown in FIG. 4, are each located centrally above the clamping device oriented toward the grinding wheel 31, that is, for instance the clamping device D in FIG. 4, and the middle upper clamping device, for instance the upper clamping device A in FIG. 4. The other gripper 42a associated with the slide 37 can be moved into position 2 and into a position 3; the latter—as shown in FIG. 3—is associated with the storage device 47.

The workpiece socket 25 is in the position shown in FIG. 4 when it is in its initial or basic position. The gripper 42 is in position 1. The gripper 42a is in position 2. The clamping device A is above, in position 2, that is, below the gripper 42a. The gripper 42 takes a finished ground scissors part 1 from the clamping device D associated with the grinding wheel 31. The gripper 42a places an unground scissors part 1 in the clamping device A. The grinding of the inner face of the scissors part 1 then ensues.

During this grinding operation the gripper 42 transfers the finished scissors part 1 to the gripper 42a. The gripper 42a is moved into position 3 and places the finished scissors part in the lifting device 48 of the storage device 47. The gripper 42 is returned empty to the position 2.

After the grinding of the inner face 7, the clamping device A is pivoted back upward. The gripper 42 takes the scissors part 1 out of the clamping device A and transfers it to the gripper 42a. In this process the scissors part 1 is turned over. The workpiece socket 25 is rotated by an angle of 180°, so that the clamping device C arrives at the top. At the same time the Y slide 21 is moved in such a way that the clamping device C arrived below the gripper 42a in position 2. The gripper 42a places the scissors part 1 in the clamping device C. Next the workpiece socket is rotated by an angle of 90° into its operating position in front of the grinding wheel 31. The grinding of the outer face 13 now takes place. The gripper 42a is moved into position 3 and retrieves an unground scissors part from the storage device 47.

After the grinding of the outer face 13, the workpiece socket 25 is rotated back again by 90°, so that the clamping device C arrives at the top. The gripper 42 located above it in position 1 takes the scissors part 1 out of the clamping device C. The workpiece socket 25 is then rotated such that the clamping device A returns to the upper position. At the same time, the gripper 42 moves into position 2 and places the scissors part 1 into the clamping device B. Next the workpiece socket is rotated by 180°, and the grinding of the cutting edge 6 takes place.

After that, the workpiece socket 25 is again rotated by 180°, so that the clamping device A again returns to the top. The gripper 42 is now located in position 2 above the clamping device D and removes the scissors part 1 and moves into position 1. The Y slide is driven in the opposite direction, so that the gripper 42 having the scissors part 1 is located above the clamping device D. It places the scissors part 1 into the clamping device D. Next the grinding of the back 12 takes place. During this time, the gripper 42, which until now has always been located above the storage device 47, moves with a new unground scissors part 1 into position 2. After that, this grinding cycle is repeated.

By corresponding triggering of the motors 19, 22, 27 by of the control means 29, the scissors parts 1 during grinding execute a superimposed motion in the X and Y direction and about the Z axis.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalent of the disclosed embodiments. It is to be understood that the phraseology or terminology employed herein is for the purpose of description and not of limitation.

What is claimed is:

1. A grinding machine for grinding elongated parts of workpieces having faces to be ground that are substantially parallel to a common primary longitudinal direction comprising:

a grinding device having a grinding wheel;

said grinding wheel adapted to rotate about an axis of rotation;

said grinding device having a workpiece socket with a clamping device for retaining the workpiece during a grinding operation;

said grinding device having a guide device for guiding the workpiece socket during the grinding operation;

said workpiece socket being disposed on a compound slide which is displaceable in a plane of motion (X-Y plane) and is pivotable about a first pivot (Z) axis;

the workpiece socket has at least one clamping device disposed in such a manner on the workpiece socket that the primary longitudinal direction of a fastened-in workpiece extends substantially parallel to the pivot axis;

the pivot axis of the workpiece socket extends parallel to the plane of motion of the compound slide, and during the grinding extends at a fixed angle approximately perpendicular to the axis of rotation of the grinding wheel;

the grinding wheel is a cup wheel and remains stationary during grinding;

said compound slide comprising:

an X-slide movable in a first direction; and a Y-slide movable in a second direction perpendicular to the first direction and attached to said X-slide;

said machine further comprising:

a first motor for moving said X-slide;

a second motor for moving said Y-slide;

a third motor provided on said Y-slide for pivoting said workpiece socket;

a computerized numerical control means for triggering said first, second and third motors, whereby said workpiece socket is guided during the grinding operation solely by said first, second and third motors.

2. The grinding machine of claim 1 wherein the workpiece socket includes a plurality of clamping devices, the number of clamping devices corresponding to the number of faces to be ground on the workpiece.

3. The grinding machine of claim 2 having four clamping devices disposed on the circumference of the workpiece socket.

4. The grinding machine of claim 2 wherein said clamping devices are disposed at the same angular interval from one another on the workpiece socket.

5. The grinding machine of claim 1 wherein each clamping device has a support and at least one stop for the workpiece, at least one of which support or stop for the workpiece is moveable toward the other, so as to fasten the workpiece in place, and is moveable away from the other in order to release the workpiece.

6. The grinding machine of claim 5 wherein a prestressed compression spring engages one of either the support or the stop for the workpiece and presses said support or stop for the workpiece toward said other one of said stop for the workpiece or support.

7. The grinding machine of claim 6 wherein a hydraulically actuated opening cylinder engages one of said support or stop for the workpiece and acts oppositely to the compression spring.

8. The grinding machine of claim 1 wherein said compound slide is pivotable relative to the cup wheel about a second axis that is perpendicular to said plane of motion.

9. The grinding machine of claim 8 wherein the compound slide is pivotable by approximately 30° about the second axis.

10. The grinding machine of claim 1 wherein the workpiece socket is displaceable only in the X-Y plane and is rotatable only about the pivot axis.

11. The grinding machine of claim 1 wherein the workpiece socket is attached to said Y slide and protrudes freely beyond said Y slide in the direction toward the grinding wheel.

* * * * *